United States Patent [19]

Gifford

[11] Patent Number: 4,848,092

[45] Date of Patent: Jul. 18, 1989

[54] HEAT EXCHANGER FOR CRYOGENIC REFRIGERATOR

[76] Inventor: Peter E. Gifford, 610 Euclid Ave., Syracuse, N.Y. 13210

[21] Appl. No.: 103,890

[22] Filed: Oct. 2, 1987

[51] Int. Cl.[4] ..... F25B 9/00

[52] U.S. Cl. ..... 62/6; 123/41.69; 165/164

[58] Field of Search ..... 62/6; 165/164; 123/41.69

[56] References Cited

U.S. PATENT DOCUMENTS

| | | | |
|---|---|---|---|
| 2,285,811 | 6/1942 | Gay | 123/41.69 |
| 2,399,468 | 4/1946 | Cole | 123/41.69 |
| 2,906,101 | 9/1959 | McMahon et al. | 62/6 |
| 3,118,285 | 1/1964 | Malaker et al. | 62/6 |
| 3,119,237 | 1/1964 | Gifford | 62/6 |
| 3,125,863 | 3/1964 | Hood | 62/175 |
| 3,188,822 | 6/1965 | Daunt | 62/6 |
| 3,205,668 | 9/1965 | Gifford | 62/6 |
| 4,036,027 | 7/1977 | Bamberg | 62/6 |
| 4,209,061 | 6/1980 | Schwemin | 165/10 |
| 4,478,276 | 10/1984 | Rosenbaum et al. | 62/6 |
| 4,490,983 | 1/1985 | Gifford et al. | 62/6 |
| 4,584,839 | 4/1986 | Jensen et al. | 62/6 |

*Primary Examiner*—Ronald C. Capossela
*Attorney, Agent, or Firm*—Wall and Roehrig

[57] ABSTRACT

A cryogenic refrigerator utilizing the Gifford-McMahon cycle that includes a cylinder having a warm end and a cold end, a displacer slidably mounted within the cylinder to form an expansion chamber at the cold end of the cylinder, a regenerator housing having an inlet end connected to a source of refrigerant and an outlet end connected to said expansion chamber whereby refrigerant from said source is passed in and out of said chamber through the regenerator, and a heat exchanger for placing the warm end of the displacer cylinder in heat transfer relationship with the inlet end of the regenerator housing whereby heat energy from the warm end of the cylinder is transferred rapidly into the refrigerant as it moves out of the regenerator back to the source.

4 Claims, 1 Drawing Sheet

HEAT EXCHANGER FOR CRYOGENIC REFRIGERATOR

BACKGROUND OF THE INVENTION

This invention relates to a cryogenic refrigerator and, in particular, to a heat exchanger suitable for use in a cryogenic refrigerator utilizing the Gifford-McMahon refrigeration cycle.

A thermodynamic refrigeration cycle generally referred to as the Gifford-McMahon cycle, is disclosed in U.S. Pat. No. 2,906,101. A two-stage refrigerator utilizing this cycle is further described in U.S. Pat. No. 3,312,072 wherein a pair of different diameter cylinders are employed to process helium gas so as to attain extremely low temperatures. In this particular multiple stage embodiment, each cylinder slidably contains a displacer that is capable of reciprocating within the cylinder to vary the volume of an expansion chamber located at the bottom of the displacer. Initially, the refrigerant (helium gas) is compressed outside of the chamber to a higher pressure and is then cycled through the chamber to thermodynamically reduce the temperature of the working fluid down into the cryogenic region. The upper part of the displacer cylinders, however, remains relatively warm during the process. It has been noted that heat can build up in this critical region to a point where the seals acting between the displacer and the cylinder wall are harmed or destroyed. A heat build up in this critical region can also adversely effect the movement of the displacer within the cylinder. In the case of a multiple stage machine, that is a machine employing more than one displacer, the second stage in the machine is size limited by the amount of heat generated in this area. Typically, the maximum size of the last stage displacer element is only about one inch in diameter. This, in turn, seriously limits the capacity of multiple stage machines utilizing the Gifford-McMahon cycle.

SUMMARY OF THE INVENTION

It is therefore a primary object of the present invention to improve cryogenic machines utilizing the Gifford-McMahon refrigeration cycle.

It is a further object of the present invention to increase the capacity of multiple stage refrigeration machines utilizing the Gifford-McMahon refrigeration cycle.

It is a still further object of the present invention to provide a heat exchanger for cooling critical regions in a refrigeration machine utilizing the Gifford-McMahon cycle to extend the life of the seals utilized therein and to further improve the operational efficiency of the machines.

Another object of the present invention is to provide a heat exchanger for cooling in critical regions in a refrigeration machine utilizing the Gifford-McMahon thermodynamic cycle without having to increase the power consumption of the machine. These and other objects of the present invention are attained by means of a cryogenic refrigerator utilizing the Gifford-McMahon cycle that includes at least one cylinder having a warm end and a cold end, a displacer slidably mounted in the cylinder to form an expansion chamber at the cold end thereof, a regenerator having a inlet connected to a source of refrigerant and an outlet connected to the expansion chamber whereby refrigerant from said source is passed in and out of said chamber through the regenerator, and a heat exchanger for placing the warm end of the cylinder in heat transfer relation with the inlet end of the regenerator whereby heat energy from the warm end of the cylinder is transferred into refrigerant as it moves out of the regenerator back to the source.

BRIEF DESCRIPTION OF THE DRAWING

For a better understanding of these and other objects of the present invention, reference is had to the detailed description of the invention which is to be read in conjunction with the following drawing, wherein.

High pressure helium gas, which is herein employed as a refrigerant, is delivered to the inlet port 20 from a compressor 18 at a pressure of about 300 PSI and is exhausted from the refrigerator via a discharge port 21 at a lower pressure of about 60 PSI. The discharge port 21 is generally connected to the suction side of the compressor so that the refrigerant can be recycled through the machine.

Figure 1:
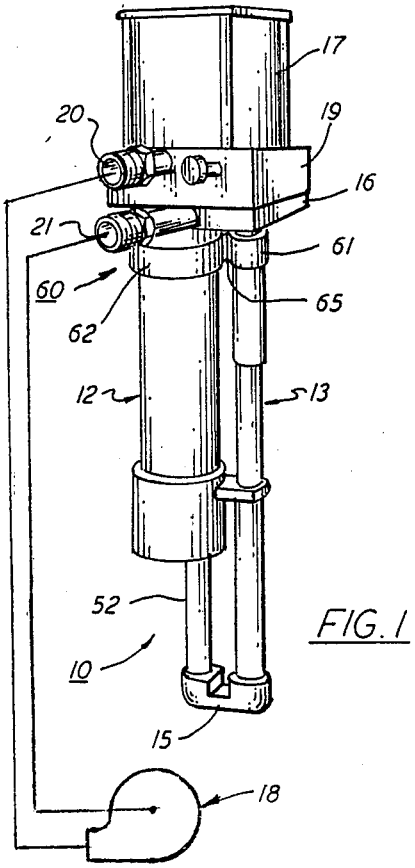
FIG. 1 is a perspective view of a cryogenic refrigerator embodying the teachings of the present invention.
Figure 2:
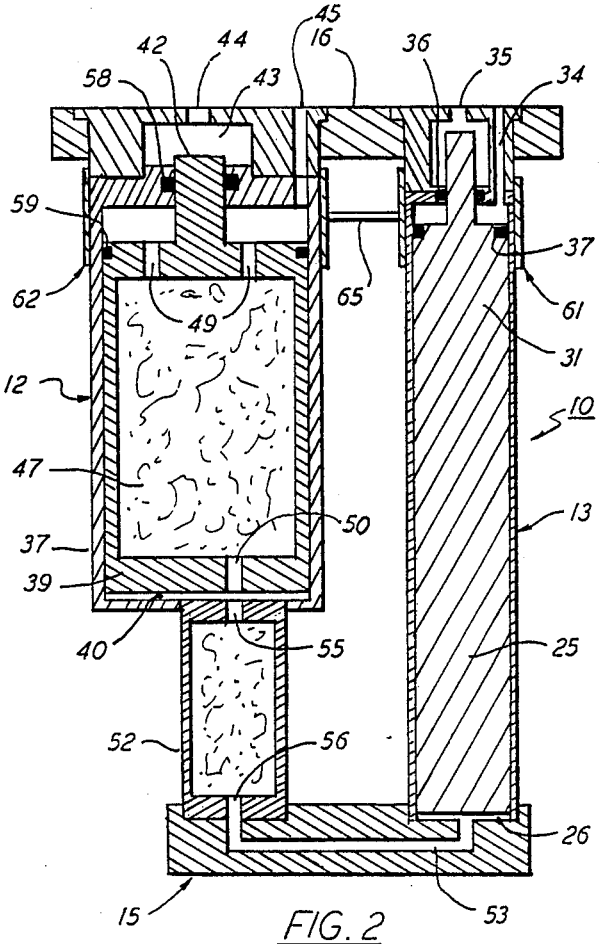
FIG. 2 is an enlarged partial view in section of the two stage refrigerator shown in FIG. 1.

As further illustrated in FIG. 2, smaller displacer cylinder 13 has slidably contained therein a second stage displacer 25 which reciprocates within the cylinder to establish an expansion chamber 26 at the cold end 27 of the cylinder. An expandable chamber 29 is also located at the opposite or warm end 31 of the cylinder. A drive piston 30 is affixed to the top of the displacer which is carried within a third chamber 32 formed in the pressure head 16. Refrigerant is metered into the chambers 29 and 32 by means of inlet passages 34 and 35 respectively, in response to the positioning of the rotary control valve to raise and lower the displacer under controlled conditions. Seals 36 and 37 surround the drive piston and the top of the displacer to prevent refrigerant from escaping from the chambers 29 and 32. The larger displacer cylinder 12 also slidably houses a first stage displacer 39 to establish an expansion chamber 40 at the lower cold end of the cylinder and a second expandable chamber 41 at the upper warm end thereof. A drive piston 42 is also supported on the top of the displacer and is slidably carried within a smaller chamber 43. Seals 58 and 59 surround the top of displacer 39 and drive piston 42 to prevent refrigerant from leaking from chambers 41 and 43. Again, refrigerant is metered to the chambers 41 and 43 via passageways 44 and 45 formed in the pressure head in response to the positioning of the rotary control valve.

A first regenerator 47 is mounted inside of the first stage displacer. As explained in further detail in U.S. Pat. No. 4,490,983 the regenerator is tightly packed with fine wire screen capable of retaining heat. Accordingly, the regenerator is cooled by refrigerant passing out of the refrigerator. High pressure refrigerant entering the machine from the compressor is cooled to a relatively low temperature as it moves in the opposite direction through the regenerator. Ports 49 and 50 are provided in the displacer body to permit refrigerant to move back and forth between chambers 40 and 41 through the internally contained regenerator.

A second regenerator 52 is located between the cold end of displacer cylinder 12 and the low temperature heat exchanger 15. A flow channel 53 is formed in the exchanger 15 through which refrigerant can be exchanged between the second regenerator and the expansion chamber 26 contained within the second stage displacer cylinder. The second regenerator also contains an upper port 55 that communicates with the expansion chamber in the second stage displacer cylinder 12 and a lower port 56 that communicates with the cold head channel 53. Refrigerant can therefore be exchanged freely through the regenerator between chambers 26 and 40.

Following the teachings in the noted Gifford patent, helium gas at high pressure is permitted to expand initially within chamber 40 and 26 to a low temperature which is somewhere about twenty five degrees K and 7 K respectively. The expanding gas passes from expansion chamber 26 through the second regenerator 52 into the first expansion chamber 40. It then joins the gas expanding out of chamber 40 and passes through the first stage regenerator 47 out ports 49 to return to the source.

Upon full expansion of the refrigerant in the second stage chamber 26, and the refrigerant has been permitted to pass back to the compressor through the two regenerators 47 and 52. The refrigerant that is moved out of the first stage displacer cylinder 12 through passage 45, although considerably warmed, still has a cooling effect on the warm side 38 of the first stage cylinder 12. As a result, during normal operations of the refrigerator, the warm end 38 of cylinder 12 is considerably cooler than the warm end of cylinder 13.

A heat exchanger, generally referenced 60, is herein used to place the warm end of cylinder 13 in thermal communication with the warm end of cylinder 12. The heat exchanger includes a first sleeve 61 surrounding the top portion of cylinder 13 and a second sleeve 62 that similarly surrounds the top portion of cylinder 12. The sleeves are formed of a metal, such as copper, that has a high coefficient of thermal conductivity. The sleeves are placed in thermal communication by means of at least one conductive bar 65 that transmits heat rapidly from sleeve 61 to sleeve 62.

As previously noted, refrigerant that is being expanded out of the regenerator 47 is at a relatively low temperature and thus serves to cool the warm end of the first stage cylinder. As a result, the warm end of the first stage cylinder remains at a lower temperature than the warm end of the second stage cylinder. The heat exchanger thus serves to draw heat away from what has heretofore been typically the warmest section of the refrigerator and carry this heat out of the machine in the expanding refrigerator gases. By use of the present heat exchanger, unwanted heat is rapidly and effectively drawn away from the critical seal regions of both displacer cylinders thereby preventing heat breakdown of the seals. The heat exchanger also enhances the operation of the refrigerator in that it prevents unwanted heat expansion in the displacer assemblies which can adversely effect the movement of the displacers within the surrounding cylinders. In the case of a multi stage machine such as that herein described, the size of the last stage displacer has heretofore been limited because of the considerable heat build up in this critical region. Utilizing the simple heat exchanger of the present invention, it is now possible to increase the size of the last stage displacer and thus the capacity of a multiple stage machine.

Figure 3:
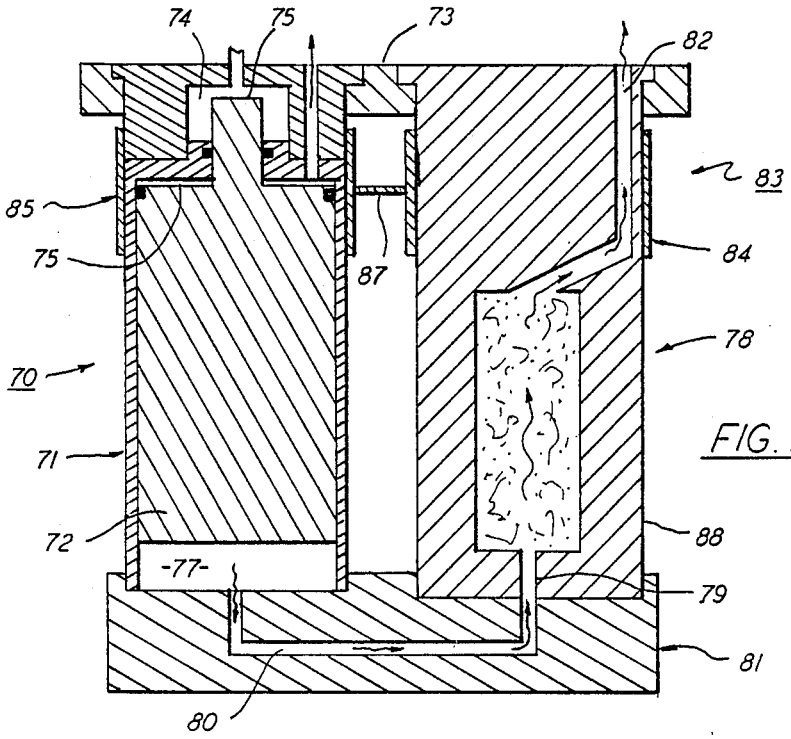
FIG. 3 is a sectional view showing a single stage refrigerator utilizing the teachings of the present invention. DETAILED DESCRIPTION OF THE INVENTION Turning now to the drawing, and in particular, FIGS. 1 and 2, there is illustrated a multiple stage cryogenic refrigerator 10 employing the well-known Gifford-McMahon refrigeration cycle to attain very low temperatures. The machine includes a first displacer cylinder 12 and a smaller second displacer cylinder 13 that are connected to a common cold head 15. The upper part of each cylinder is attached to a pressure head 16. As explained in greater detail to the aforementioned U.S. Pat. No. 3,312,072, a rotary control valve (not shown) is mounted in a control unit 19 over the pressure head of the machine and is driven by an electrical motor 17 for passing in a selected sequence high and low pressure refrigerant in and out of the displacer cylinders. The high and low pressure refrigerant is supplied from a remote refrigerant compressor unit. To the extent necessary to more fully understand the operation of the rotary valve system and the Gifford-McMahon multistage refrigeration process, the disclosure found in the above noted patent is herein incorporated by reference.

Turning now to FIG. 3 there is shown a single stage refrigerator that operates on the Gifford-McMahon cycle and which utilizes the teachings of the present invention. The refrigerator 70 has a single displacer cylinder 71 that houses a displacer 72. The top of the cylinder is closed by a pressure head 73 to establish a drive chamber 74 housing drive pistons 75 and a top chamber 76 located over the displacer body. An expansion chamber 77 is found in the lower part of the cylinder and explained in the above noted U.S. Pat. No. 2,906,101, refrigerant in the form of helium gas is permitted to expand under controlled conditions within this chamber to attain extremely low temperatures.

The single stage machine includes an external regenerator 78 in cylinder 88 having a lower port 79 that communicates with the expansion chamber 77 through means of a flow channel 80 passing through cold end 81. Refrigerant is drawn from the regenerator by means of port 82 and returned to the suction side of the system compressor.

A heat exchanger 83 is arranged to cool the upper or warm end of the displacer chamber. The heat exchanger includes a first sleeve 84 which surrounds the upper part of the external regenerator and a second sleeve 85 that surrounds the upper or warm end of the displacer cylinder. Both sleeves can include radially extended fins 86—86 for discharging heat energy into the surrounding ambient if possible. At least one conductive bar 87 connects the two sleeves which functions to conduct heat energy rapidly away from the warm end of displacer cylinder 71. The refrigerant being discharged from the regenerator back to the compressor is at a relatively low temperature and thus serves to carry heat energy away from the heat exchanger and thus cool the critical warm end of the displacer cylinder 71.

Again, it should be noted that the sleeve 85 of the heat exchanger 82 surrounds the critical seal region of the displacer 72. By cooling this normally warm region, the seal life is considerably prolonged and the operation of the displacer is enhanced. It should be further noted that these advantages are gained without having to increase the power consumption of the machine.

While this invention has been explained with reference to the structure disclosed herein, it is not confined to the details set forth and this application is intended to cover any modifications and changes as may come within the scope of the following claims.

What is claimed is:

1. A cryogenic refrigerating system employing the Gifford-McMahon refrigeration cycle that includes a refrigeration unit that contains a regenerator housing and a displacer housing, an inlet means for connecting the refrigeration unit to a discharge line of a remote refrigeration compressor and an outlet means for connecting the unit to a suction line of said compressor, said regenerator housing having a warm end and a cold end and containing therein a regenerator unit, said displacer housing having a warm end and a cold end and slidably containing therein a displacer that is free to reciprocate in said housing between the warm end and the cold end thereof, connecting means for placing the cold end of the regenerator housing in fluid flow communication with the cold end of the displacer housing whereby refrigerant is exchanged between the housings, control means connected to the warm end of the regenerator housing for cycling refrigerant from said compressor into and out of the displacer housing through said regenerator unit whereby refrigerant can be expanded to an extremely low temperature in the displacer unit before being returned through the regenerator unit to the remote compressor, and a heat exchanger means for placing the warm end of the displacer housing in physical contact with the warm end of the regenerator housing so that heat energy from the displacer housing is conducted into refrigerant as it is returned to the remote compressor through said regenerator unit.

2. The refrigerator of claim 1 wherein said heat exchanger means further includes a first sleeve that surrounds the warm end of the regenerator housing, a second sleeve that surrounds the warm end of the displacer housing and at least one heat conductive member that is connected to both of said sleeves.

3. The refrigerator of claim 1 that further includes seal means acting between the displacer and said displacer housing at the warm end thereof.

4. The refrigerator of claim 1 that further includes a second displacer that is slidably contained within said regenerator housing and said regenerator unit is contained within said second displacer.

* * * * *